US006176041B1

(12) United States Patent
Roberts

(10) Patent No.: US 6,176,041 B1
(45) Date of Patent: Jan. 23, 2001

(54) CASEMENT ASSEMBLY AND A LATCH MECHANISM THEREFOR

(75) Inventor: James Wilford Roberts, P.O. Box 1427, Tupelo, MS (US) 38802

(73) Assignee: James Wilford Roberts, Tupelo, MS (US)

( * ) Notice: Under 35 U.S.C. 154(b), the term of this patent shall be extended for 0 days.

(21) Appl. No.: 09/362,746

(22) Filed: Jul. 29, 1999

(51) Int. Cl.[7] ..... E05C 9/00
(52) U.S. Cl. ..... 49/395; 70/103; 70/130
(58) Field of Search ..... 49/394, 395; 70/129, 70/130, 103, 104, 109, 82, 84; 160/104, 369; 292/3, 32, 34, 37, 62

(56) References Cited

U.S. PATENT DOCUMENTS

| | | | |
|---|---|---|---|
| 2,708,478 | 5/1955 | Wolf et al. . | |
| 2,883,225 | 4/1959 | Akehurst . | |
| 3,953,061 * | 4/1976 | Hansen et al. | 292/34 X |
| 4,005,886 | 2/1977 | Lirette . | |
| 4,362,328 | 12/1982 | Tacheny et al. . | |
| 4,803,808 | 2/1989 | Greisner . | |
| 5,090,750 | 2/1992 | Lindqvist . | |
| 5,244,238 | 9/1993 | Lindqvist . | |
| 5,280,755 | 1/1994 | Batur . | |
| 5,595,408 | 1/1997 | Jeche . | |
| 5,791,700 | 8/1998 | Biro . | |
| 5,806,353 | 9/1998 | Pages . | |

FOREIGN PATENT DOCUMENTS

| | | | |
|---|---|---|---|
| 2144170 * | 2/1985 | (GB) | 292/3 |

* cited by examiner

*Primary Examiner*—Jerry Redman
(74) *Attorney, Agent, or Firm*—Ronald P. Kananen; Rader, Fishman & Grauer

(57) ABSTRACT

A casement assembly comprising a casement frame defining a passageway in which is moveably mounted a closure element that can be moved to open and close the passageway relative to the casement frame. A latch is provided on the closure element for locking the closure element relative to casement frame. The latch includes a rotating cam having an eccentric surface that abuts an inner end of a laterally sliding rod whose outer end is brought into and out of interference with the casement frame to lock the moveable element with respect to the casement frame.

27 Claims, 4 Drawing Sheets

CASEMENT ASSEMBLY AND A LATCH MECHANISM THEREFOR

BACKGROUND OF THE INVENTION

1. Field of the Invention

The invention generally relates to a casement defining an opening in a structure, such as a wall, in combination with a closure element that is movable with respect to the casement for opening or closing at least a portion of the casement opening; and, more particularly, to a latch mechanism for fixing the relative position of the closure element with respect to the casement, preferably in the closed position.

2. Related Art

A casement assembly comprising a combination of a casement frame and a closure element is well known and finds common examples in security screens, sliding glass doors, or double hung windows, to name a few examples. Generally, the casement frame is positioned within a wall or similar structural element to define a passage therethrough. The closure element (generally a window, screen or door) is movable (generally slidable or pivotal) with respect to the casement frame for alternatively opening or closing the passageway.

For safety, it is common to provide a latch mechanism for locking the closure element in a fixed position relative to the casement frame, preferably in the closed position. Previous latch mechanisms typically include one or more locking rods mounted to the closure element and laterally movable between a retracted and extended position for inserting and removing an outer end of the bar into and out of engagement with the casement frame to prevent the movement of the closure element with respect to the casement frame. A laterally movable or rotatable handle or knob was directly mechanically coupled to the inner end of the rod for moving the rod between the extended and retracted positions as the handle is slid or rotated. The direct mechanical coupling between the rod inner end and the knob or handle typically included rotatably pinning the end of the rod to the handle or providing an intermediate link having one end pinned to the rod and the other end pinned to the handle or knob. Examples of such latch mechanisms with direct mechanical links are illustrated in U.S. Pat. No. 2,708,478, filed May 17, 1955, U.S. Pat. No. 2,883,225, filed Oct. 16, 1953, U.S. Pat. No. 4,362,328, issued Dec. 7, 1982, U.S. Pat. No. 4,803,808, issued Feb. 14, 1989, U.S. Pat. No. 5,090,750, issued Feb. 25, 1992, U.S. Pat. No. 5,595,408, issued Jan. 21, 1997, and U.S. Pat. No. 5,806,353, issued Sep. 15, 1998 to name a few.

A disadvantage of the prior art latches lies in the direct mechanical linkage, which can often be difficult to extend and retract because of the inherent friction or resistance in the mechanical linkages. Many of the mechanical linkages change angular orientation with respect to the handle or knob as it is rotated, resulting in quickly varying relatively small lever arms that require applying relatively large and varying rotational forces to the handle or knob to effect the extension or retraction. The magnitude and varying nature of the operational force results in jerky operation and sometimes a very high initial force. The combination of these effects can often lead to the user having to apply a relatively very large initial force until the inherent friction or resistance is overcome, resulting in the user feeling as if the latch mechanism has broken away. An additional problem lies in that the various components are typically metal and the linkages can rust, increasing the force necessary to overcome the additional resistance and exacerbating the initial force problem.

SUMMARY OF THE INVENTION

There is a desire to have a casement enclosure assembly with a latch that addresses the disadvantages of the prior art and permits the easy and repeatable locking/unlocking of the closure with respect to the casement. The invention addresses this desire by ameliorating the prior art disadvantage by providing a latch mechanism that requires a relatively low initial force alone or in combination with a casement assembly. The casement assembly comprises a casement frame that defines a passageway and a closure element that is moveably mounted to the casement frame and closes at least a portion of the passageway. The latch mechanism comprises a rod and a cam for operably moving the rod. The rod has inner and outer ends and is slidably mounted to the closure element for lateral movement between an extended position, preventing the movement of the closure element relative to the casement frame, and a retracted position, permitting the sliding movement of the closure element relative to the casement frame. The cam has at least one eccentric surface that is in substantially constant abutting relationship with the rod inner end and is rotatably mounted to the closure element for rotation between a first position and a second position for moving the rod between the retracted and extended positions.

The latch can further comprise a biasing device that biases the rod inner end against the eccentric surface. The biasing device is operably coupled between the rod and one of the closure element and the casement frame. Preferably, the biasing device comprises a mounting bracket having an eyelet that slidably receives the rod and a coil spring that is concentrically positioned relative to the rod and having one end connected to the bracket and another end connected to the rod whereby when the rod is in the extended position, the spring is compressed and applies a biasing force to the rod to urge the rod toward the retracted position.

The latch can further comprise a handle mounted to the cam for rotating the cam between the first and second positions. The handle is preferably mounted to the cam at a location is spaced from the cams rotational axis.

The cam can also comprise a stop that abuts the rod when the cam is in the second position to prevent the continued rotation of the cam beyond the second position. Preferably, the stop is a projection that extends away from the eccentric surface.

The casement assembly can include a catch that couples with the rod outer end when the rod is in the extended position to form the interference relationship. The catch can be a portion of the casement that the rod outer end overlies or an opening formed in the casement frame and sized to receive the outer end of the rod. There can also be multiple openings provided along the casement frame to permit the fixation of the closure element at discreet locations along the casement frame.

DETAILED DESCRIPTION OF THE PREFERRED EMBODIMENTS

Figure 1:
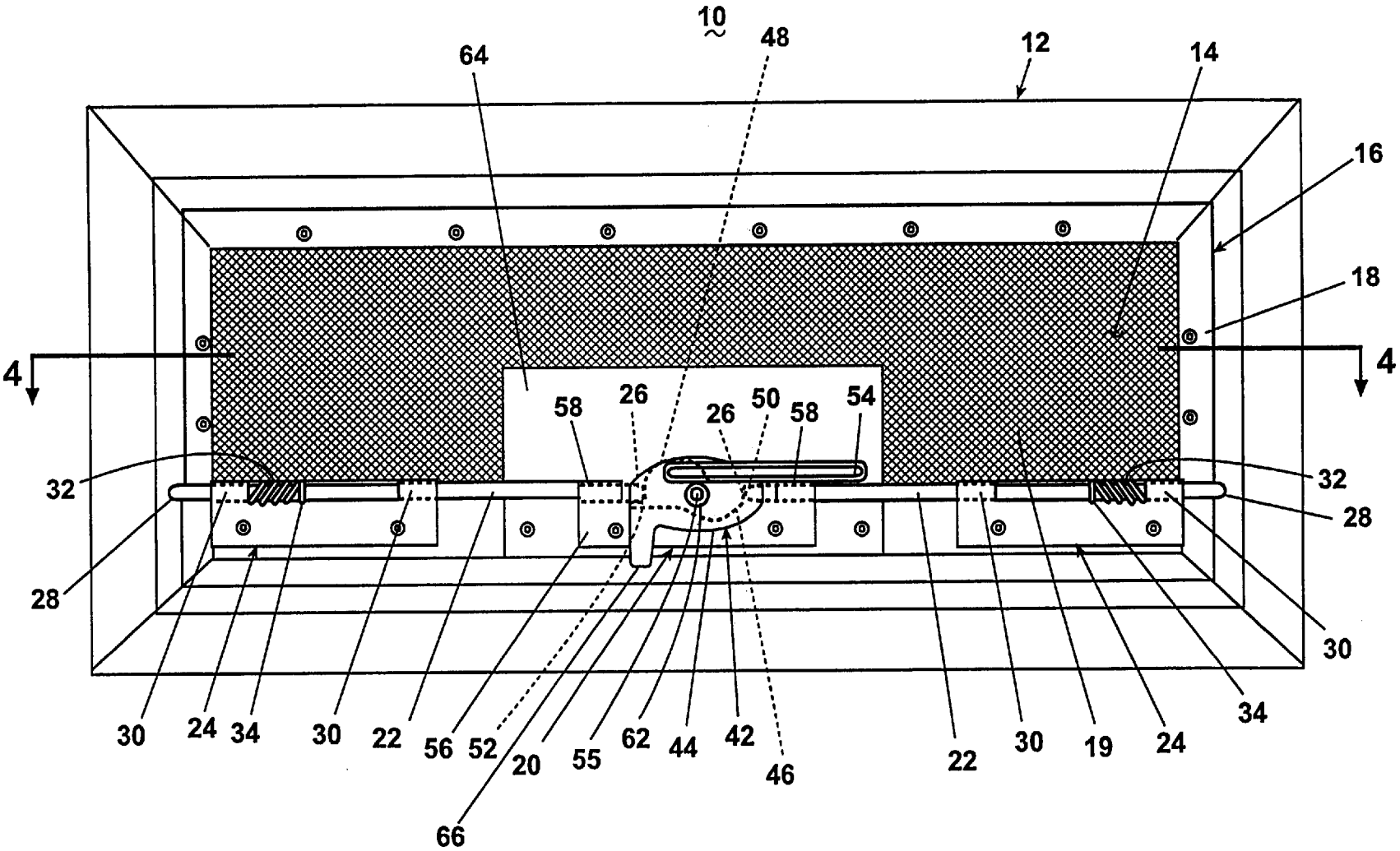
FIG. 1 is a front view of a safety screen assembly comprising a casement frame and closure element that is locked to the casement frame by a latch according to the invention.

FIG. 1 illustrates a casement assembly 10 in the context of a security screen having a casement frame 12 whose interior defines a passage 14 in which is moveably mounted a closure element 16 in the form of a screen. The screen comprises a frame 18 whose upper edge is pivotally mounted to the casement frame 12 by a hinge (not shown) for pivotal movement rearwardly as viewed in FIG. 1.

The casement assembly 10 further includes a latch 20 fixably mounted to the closure element 16. The latch 20 comprises a pair of opposing rods 22 that are slidably mounted with respect to the closure element by corresponding brackets 24. Each rod has an inner and outer end 26, 28, respectively. Each of the brackets 26 has a pair of eyelets 30 that slidably receive the rod 22 to constrain the rod 22 for lateral movement with respect to the closure element 18. A coil spring 32 is concentrically mounted over each rod 22. One end of the spring 32 abuts one of the eyelets 30 and the other end of the spring 32 is fixed to the rod 22, preferably by abutting a clip 34 mounted to the rod.

The latch 20 further comprises a cam assembly 42 comprising a cam body 44 having opposing eccentric surfaces 46, 48, which terminate in projections or stop flanges 50, 52. A handle 54 extends from the cam body 44 and is connected to the cam body at a location spaced from the rotational axis 55 of the cam body.

The cam assembly 42 further comprises a mounting bracket 56 for mounting the cam body 44 to the window 18. The cam bracket 56 has opposing eyelets 58 that slidably receive the inner ends 26, 28 of the rods 22, 24. Preferably, the cam body 44 is rotatably pinned to the cam bracket 56 by a rivet 62, which defines the rotational axis 55.

Optionally, a latch shield 64 can be disposed between the cam bracket 56 and the window 18 to deter access to the handle 54 and cam body 44 through the screen. The shield and brackets are secured to the frame by suitable mechanical fasteners. A locking tab 66 can be provided for additional locking and overlies the frame when the cam is in the closed position.

Figure 2:
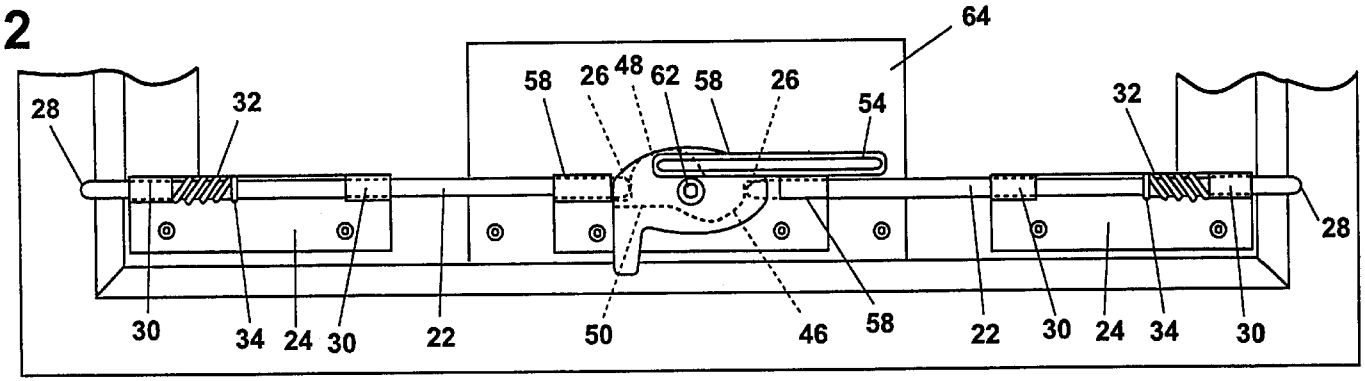
FIG. 2 is an enlarged view of the latch of FIG. 1 with the latch shown in the locked position.
Figure 3:
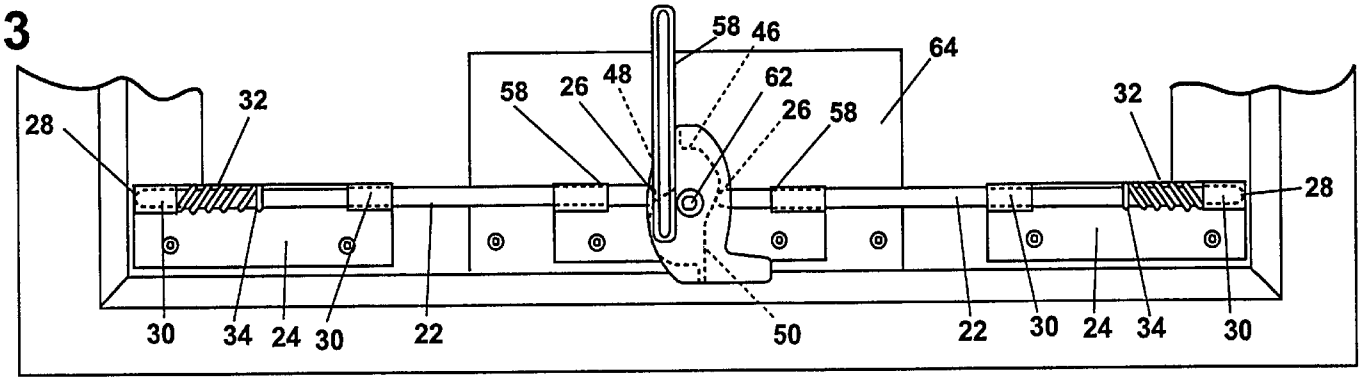
FIG. 3 is similar to FIG. 2 except that the latch is shown in the unlocked position.

The operation of the latch mechanism will be described with reference to FIGS. 2–4 and assuming the latch mechanism begins in the unlocked position as illustrated in FIG. 3. In the unlocked position, the eccentric surfaces are oriented so that the short width side of the eccentric surface is presented to the inner ends 26 of the rods 22 and the springs bias the inner ends 26 into abutting relationship with the eccentric surfaces 46, 48, respectively. In the unlocked position, the rod outer ends 28 are in the retracted position and lie within the passageway 14 and do not overlie the casement frame 12. Thus, the screen closure element 14 is free to pivot relative to the casement frame 12.

Figure 4:
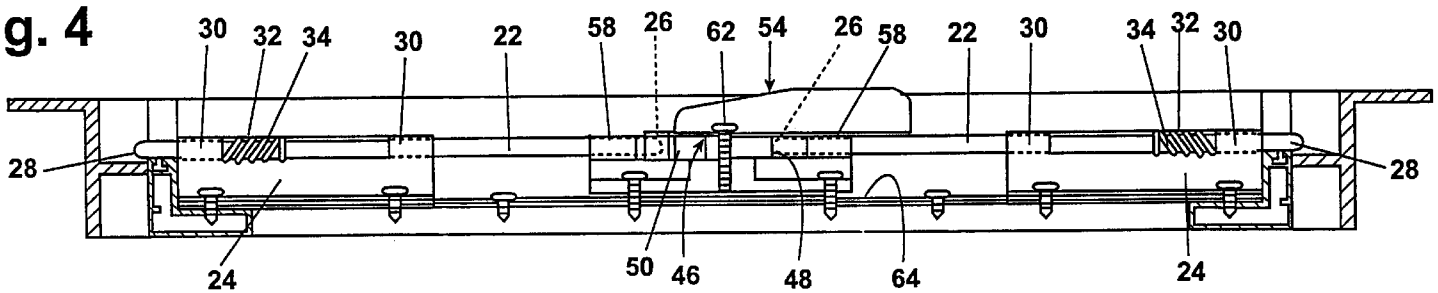
FIG. 4 is a top view of the latch in FIG. 2.

As the handle is rotated clockwise as viewed in FIGS. 2 and 4, the portion of the eccentric surfaces 46, 48 that are spaced farthest from the pivot axis 55 are presented to the inner ends 26, 28, which are held in constant abutment with the eccentric surfaces 46, 48 by the springs. Upon the rotation of the handle, the inner ends 46, 48 follow the eccentric surfaces 46, 48 until the stop flanges 50, 52 are brought into contact with the rods 22, 24, which limit further rotation of the cam body 44. The rotation of the cam body 44 results in the lateral movement or extension of the rods 22, 24 from the retracted position to the extended position where they overlie a portion of the casement frame 12 to prevent the outward pivoting of the closure element 18.

Figure 5:
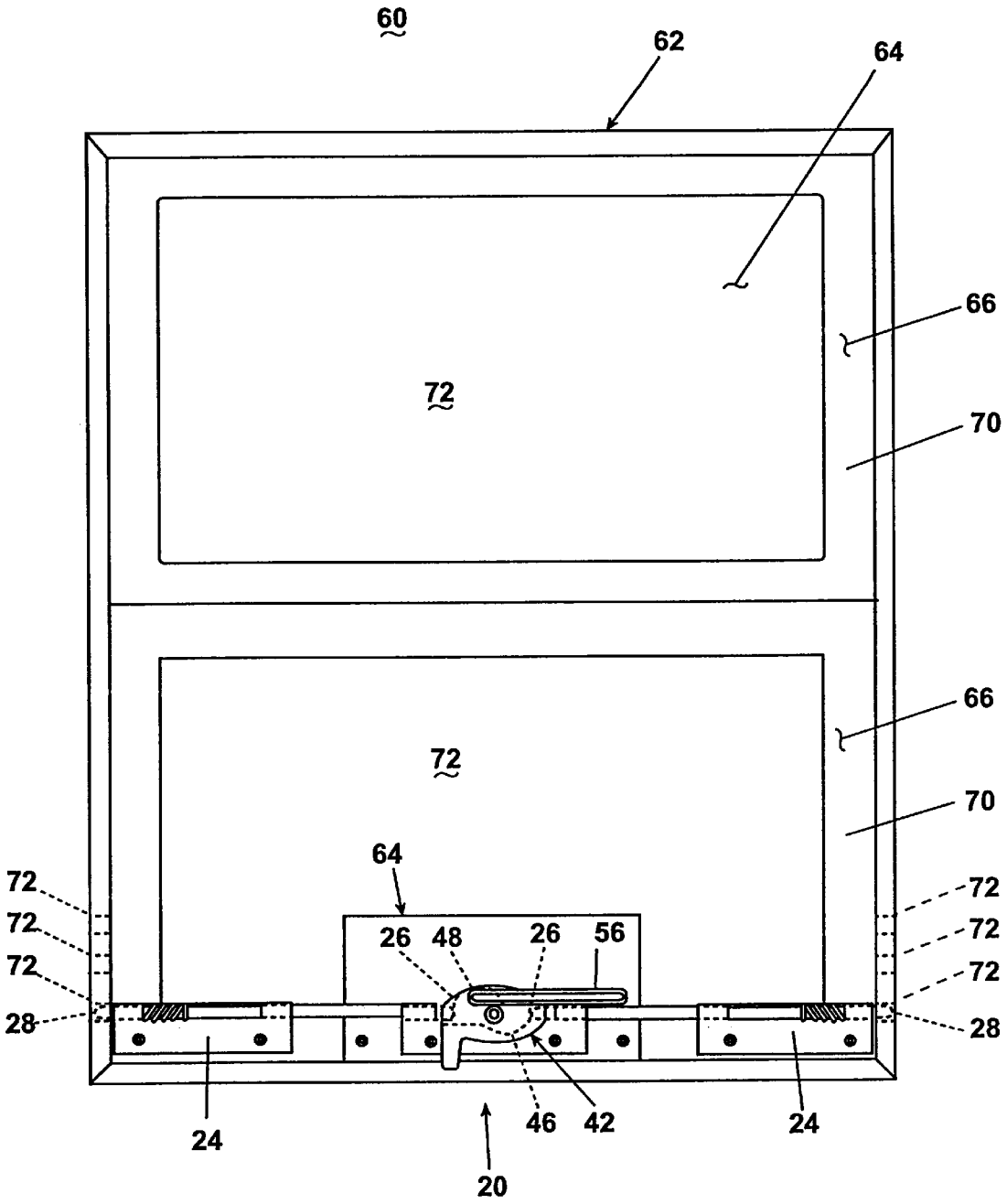
FIG. 5 illustrates the latch of FIG. 1 in the context of a double hung window.

FIG. 5 illustrates the latch 20 in the context of a double hung window assembly 60. The double hung window assembly 60 comprises a casement frame 62 defining a passageway 64 in which are positioned closure elements 66 in the form of windows. Each of the windows comprises a window frame 70, which mounts a pane of glass 72. The windows 66 are slidably mounted with respect to the casement frame 62.

The latch 20 is mounted to one of the frames 70 of the window 66 and operates identically as previously described except that the outer ends 28 of the rods do not overlie the casement frame 62 in the extended position, but instead are received within openings 72 on the casement frame. There can be multiple openings 72 spaced vertically along the casement frame 62 to permit the locking of the window 66 at various vertical positions relative to the casement frame 62.

Figure 6:
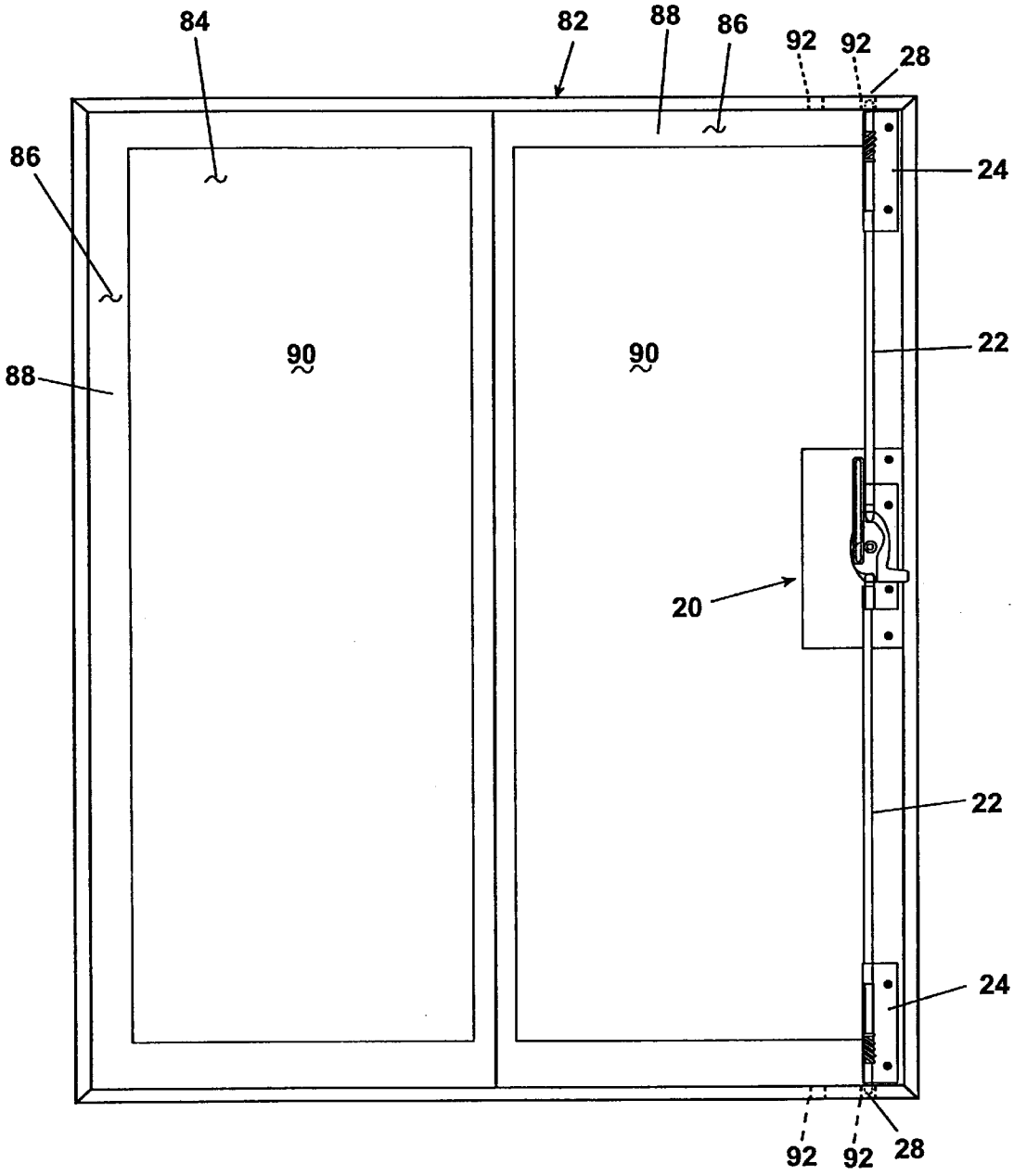
FIG. 6 illustrates the latch of FIG. 1 in the context of a sliding glass door.

FIG. 6 illustrates the latch 20 in the context of a sliding glass door assembly 80, which comprises a casement frame 82 defining a passageway 84. A pair of sliding glass doors 86 are slidably mounted within the casement frame 82 to permit the opening and closing of the passageway 84. Each of the sliding glass doors 86 comprises a frame 88 that is slidably mounted to the casement frame and which mounts a glass or screen element 90.

The latch 20 is mounted to one of the sliding glass doors 86 in a manner similar to that of the double hung window of FIG. 5 except that the latch is vertically oriented instead of horizontally oriented. The casement frame 82 also includes openings 92 that receive the ends 28 of the rods when they are in the extended position in the same manner as described for the double hung windows. As with the double hung window of FIG. 5, the openings 92 can be spaced along the casement frame 82 so that the sliding door 86 can be latched in any one of a variety of horizontal positions.

The latch, according to the invention, can be used in a variety of contexts such as doors, windows, and cabinets. Door examples include patio doors, carport doors, firewall doors, overhead doors, sliding glass doors, screen doors, and safety screen doors. Window examples include single hung windows, double hung windows, triple hung windows, tilt windows, slider windows, casement windows, and swivel windows. Cabinet examples include flammable liquid storage cabinets, file cabinets, industrial cabinets and desk cabinets. The latch overcomes the disadvantages of prior art latches by maintaining a constant abutting relationship between the eccentric surface on the cam and the inner end of the rod wherein the eccentric surface extends and retracts the rods without changing the angular orientation of the rods to thereby eliminate the need for the prior art mechanical linkages between the rods and the handle.

While the invention has been specifically described in connection with certain specific embodiments thereof, it is to be understood that this is by way of illustration and not of limitation, and the scope of the appended claims should be construed as broadly as the prior art will permit.

What is claimed is:

1. A latch for a casement frame assembly comprising a casement frame defining a passageway and a closure element moveably mounted to the casement frame and closing at least a portion of the passageway, the latch comprising:

a rod having opposing inner and outer ends and slidably mounted to the closure element for lateral movement between an extended position where the outer end is adapted to be in an interference relationship with one side of the casement frame, preventing movement of the closure element relative to the casement frame, and a retracted position permitting movement of the closure element relative to the casement frame; and a cam body having at least one eccentric surface with a short width side in a substantially constant, biased, abutting relationship with the inner end of said rod, and rotatably mounted to the closure element for rotation between a first position and second position for moving the rod between the retracted and extended positions, whereupon the inner end of the rod follows the eccentric surface of said cam body upon rotation of said cam body.

2. A latch according to claim 1 and further comprising a biasing device that biases the inner end against the eccentric surface.

3. A latch according to claim 2, wherein the biasing device is operably coupled between the rod and one of the closure element and the casement frame.

4. A latch according to claim 3, wherein the biasing device comprises a mounting bracket having an eyelet slidably receiving the rod and a coil spring concentrically positioned relative to the rod and having one end connected to the bracket and another end connected to the rod wherein when the rod is in the extended position, the spring is compressed and applies a biasing force to the rod to urge the rod toward the retracted position.

5. A latch according to claim 4, wherein the biasing device further comprises a clip mounted to the rod and the other end of the spring abuts the clip to connect the other end of the spring to the rod.

6. A latch according to claim 1 and further comprising a handle mounted to the cam body for rotating the cam between the first and second positions.

7. A latch according to claim 6, wherein the handle is mounted to the cam body at a location spaced from a rotational axis of the cam body.

8. A latch according to claim 1, wherein the cam body further comprises a stop that abuts the rod when the cam body is in the second position to prevent the continued rotation of the cam body beyond the second position.

9. A latch according to claim 8, wherein the stop is a projection extending away from the eccentric surface.

10. A latch according to claim 1 and further comprising a shield between the closure element and the cam body and sized to prevent direct access to the cam body from a side of the closure element opposite the shield.

11. A latch according to claim 1 and further comprising a second rod having opposing inner and outer ends and slidably mounted to the closure element for lateral movement between an extended position where the outer end is adapted to be in an interference relationship with an opposite side of the casement frame than the first rod, preventing movement of the closure element relative to the casement frame, and a retracted position permitting movement of the closure element relative to the casement frame, and the cam body has a second eccentric surface opposing the at least one eccentric surface and the second eccentric surface with a short width side is in a substantially constant, biased, abutting relationship with the second rod inner end wherein rotation of the cam body between the first position and second position moves the second rod between the retracted and extended positions.

12. A latch according to claim 11 and further comprising first and second mounting brackets mounted to the closure element on opposite sides of the cam body and associated with one of the rods, each mounting bracket having an eyelet slidably receiving the associated rod and a coil spring concentrically positioned relative to the associated rod and having one end connected to the bracket and another end connected to the associated rod wherein when the associated rod is in the extended position the spring is compressed and applies a biasing force to the rod to urge the rod toward the retracted position.

13. A latch according to claim 12 and further comprising a handle mounted to the cam body for rotating the cam body between the first and second positions.

14. A latch according to claim 12, wherein the cam body further comprises a stop that abuts the rod when the cam body is in the second position to prevent the continued rotation of the cam body beyond the second position.

15. A latch according to claim 12 and further comprising a shield interposed between the closure element and the cam body and sized to prevent direct access to the cam from a side of the closure element opposite the shield.

16. A latch according to claim 1, wherein the closure element is a safety screen pivotally mounted to the casement frame.

17. A latch according to claim 16, wherein the rod outer end overlies a portion of casement frame to prevent the pivoting of the security screen relative to the casement frame to form the interference relationship.

18. A casement assembly comprising:

a casement frame defining a casement opening;

a closure element movably mounted to the casement frame and closing at least a portion of the casement opening, a first rod having opposing inner and outer ends and slidably mounted to the closure element for lateral movement between an extended position where the outer end is adapted to be in an interference relationship with one side of the casement frame, preventing movement of the closure element relative to the casement frame, and a retracted position permitting movement of the closure element relative to the casement frame; and a cam assembly having a cam body with at least one eccentric surface having a short width side in substantially constant, biased, abutting relationship with the inner end of said rod and rotatably mounted to the closure element for rotation between a first position and second position for moving the first rod between the retracted and extended positions.

19. A casement assembly according to claim 18, wherein the casement frame further comprises a catch that couples with the first rod outer end when the first rod is in the extended position to form the interference relationship, preventing the sliding of the closure element relative to the casement frame.

20. A casement assembly according to claim 19, wherein the catch is an opening formed in the casement frame and sized to receive the outer end of the first rod.

21. A casement assembly according to claim 20, wherein the catch comprises multiple openings spaced along the casement frame for limiting the relative sliding of the closure element and the casement frame at discrete locations along the casement frame.

22. A casement assembly according to claim 18 and further comprising a second rod having opposing inner and outer ends and slidably mounted to the closure element for lateral movement between an extended position where the outer end is adapted to be in an interference relationship with an opposite side of the casement frame than the first rod, preventing movement of the closure element relative to the casement frame, and a retracted position permitting movement of the closure element relative to the casement frame, and the cam has a second eccentric surface opposing the at least one eccentric surface and the second eccentric surface is in substantially constant abutting relationship with the second rod inner end wherein rotation of the cam between the first position and second position moves the second rod between the retracted and extended positions.

23. A casement assembly according to claim 22 and further comprising first and second mounting brackets mounted to the closure element on opposite sides of the cam and associated with one of the rods, each mounting bracket having an eyelet slidably receiving the associated rod and a coil spring concentrically positioned relative to the associated rod and having one end connected to the bracket and another end connected to the associated rod wherein when the associated rod is in the extended position the spring is compressed and applies a biasing force to the rod to urge the rod toward the retracted position.

24. A casement assembly according to claim 23, wherein the cam further comprises a stop that abuts the rod when the cam body is in the second position to prevent the continued rotation of the cam body beyond the second position.

25. A casement assembly according to claim 18, wherein the closure element is a safety screen pivotally mounted to the casement frame.

26. A casement assembly according to claim 25, wherein the rod outer end overlies a portion of casement frame to prevent the pivoting of the security screen relative to the casement frame to form the interference relationship.

27. A latch for a casement frame assembly, comprising:

a casement frame defining a passage;

a closure element assembly moveably mounted to the casement frame and closing at least a portion of the passageway;

a rod having opposing inner and outer ends and slidably mounted to the closure element for lateral movement between an extended position where the outer end is adapted to be in an interference relationship with one side of the casement frame, preventing movement of the closure element relative to the casement frame, and a retracted position permitting movement of the closure element relative to the casement frame; and means, including a cam assembly having a cam body with at least one eccentric surface, for rotating said cam body between a first position and a second position for moving the rod laterally between the retracted and extended positions by a substantially constant, biased, abutting relationship with a short width side of the cam body and the inner end of the rod and the inner end of the rod follows the eccentric surface until stop flanges are brought into contact with the rod to limit further rotation of the cam body.

* * * * *